United States Patent [19]

Kramlehner

[11] 4,090,841

[45] May 23, 1978

[54] EQUIPMENT FOR THE HEATING OF HOLLOW CYLINDRICAL ROLLERS OF A CORRUGATED PAPER MACHINE

[75] Inventor: Karl Kramlehner, Rumlang, Austria

[73] Assignee: Asitrade AG, Grenchen, Switzerland

[21] Appl. No.: 711,665

[22] Filed: Aug. 4, 1976

[30] Foreign Application Priority Data

Aug. 14, 1975 Switzerland ..... 574010/75

[51] Int. Cl.[2] ..... F27B 9/28; F27D 3/00

[52] U.S. Cl. ..... 432/60; 432/8; 432/65

[58] Field of Search ..... 432/1, 8, 59, 60, 236, 432/65; 34/119, 240

[56] References Cited

U.S. PATENT DOCUMENTS

| | | | |
|---|---|---|---|
| 932,587 | 8/1909 | Sheldon | 432/60 |
| 1,634,353 | 7/1927 | Frantz | 432/60 X |
| 2,037,680 | 4/1936 | Duncan | 431/354 |
| 2,497,154 | 2/1950 | Dailey, Jr. et al. | 432/246 |
| 2,763,477 | 9/1956 | Marks | 432/228 |
| 3,116,915 | 1/1964 | Nesbitt | 432/222 |
| 3,452,967 | 7/1969 | Durand | 34/119 |

*Primary Examiner*—John J. Camby

*Attorney, Agent, or Firm*—Pollock, Vande Sande and Priddy

[57] ABSTRACT

In a machine, for making corrugated paper, of the kind including hollow cylindrical rollers, a process and apparatus is provided for improved heating of the rollers. Liquefied gas is burnt within the hollow interiors of the rollers, and the rollers are heated by radiation from the resultant combustion gases. A combustion tube is fitted into the interior of each roller, and a liquefied gas jet burner is located outside each roller and includes a nozzle directed towards one end of the combustion tube. A radiator tube is provided within the roller in surrounding spaced relation to the combustion tube, forming an annular space therebetween through which auxiliary air is supplied. The radiator tube is heated primarily by radiation from the combustion tube, and transmits its heat by radiation to the roller. Means are provided for cooling each bearing of the rollers.

8 Claims, 1 Drawing Figure

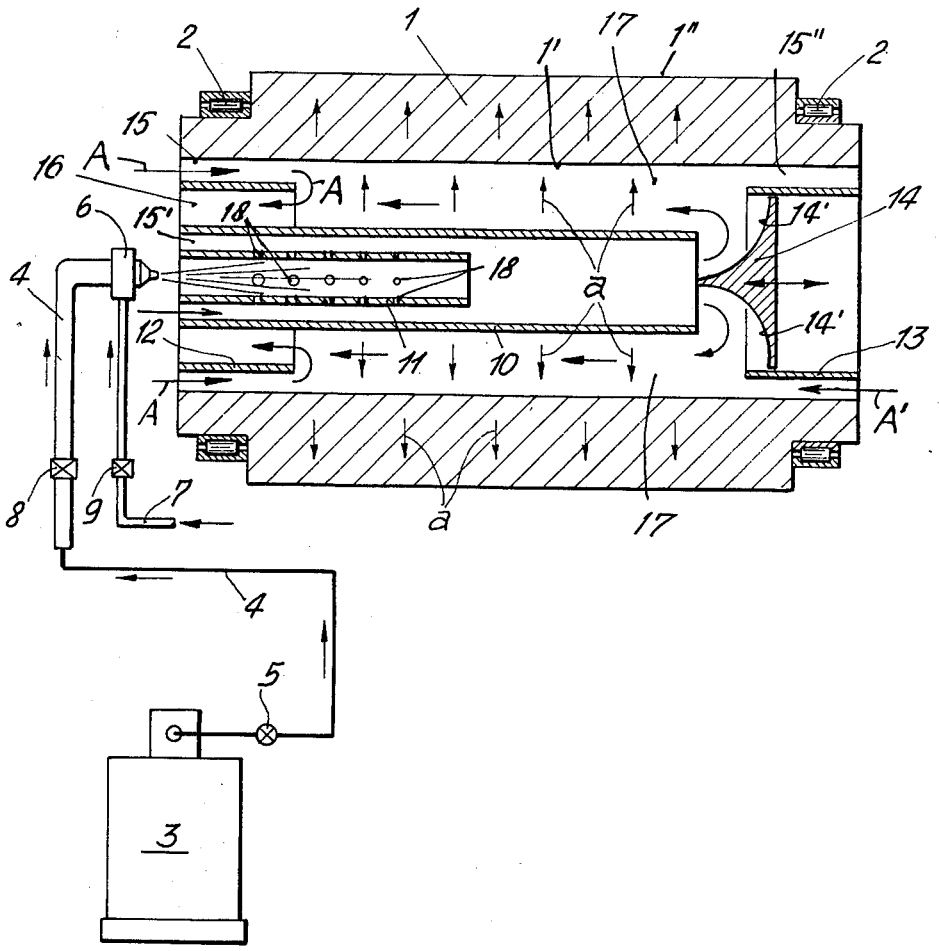
1
1'
1"
2
2
15
15'
15"
16
A
A
A'
A'
6
4
4
8
9
7
12
11
10
18
18
a
a
17
17
14
14'
14'
13
5
3

EQUIPMENT FOR THE HEATING OF HOLLOW CYLINDRICAL ROLLERS OF A CORRUGATED PAPER MACHINE

With the conventional process for heating the rollers of corrugated paper machines, in this case the grooved roller, the pressure roller and the drying assembly, heating is effected exclusively by steam. This source of heat calls for boilers, water treatment units, feed water and condenser water tanks. The purification process also requires at present an additional precipitation plant to separate out the chemicals which were added to the water. High-grade pumps and an extensive network of feed pipes are also essential to convey the steam to the corrugated paper machine. Steam traps and also condenser water pumps are necessary to return the condensed water. Seeing that a steam installation is subject to inspection at regular intervals by the Boiler Association, proper maintenance by a qualified boilerman is also required. Experience has shown that the capital costs of such a steam installation are very high, so that not only the operating expenses, but also the costs of acquisition have an unfavourable effect on profitability.

The present invention now concerns a process for the heating of hollow cylindrical rollers of a corrugated paper machine and equipment for effecting the same, by means of which the task on which the invention is based is intended to be fulfilled simply and cheaply.

In accordance with the process forming the basis of the invention, liquefied gas is burnt in the hollow spaces of the rollers in a jet burner and the rollers are heated by the radiation of heat from the combustible gases produced.

The invention also concerns equipment for effecting the process, characterized by the fact that a liquefied gas jet burner is fitted outside each of the rollers, the nozzle of which is directed towards a combustion tube located in the interior of the roller, and that, in spaced surrounding relation to the combustion tube, there is a radiator tube for the purpose of receiving heat from the combustion tube and transmitting the heat by radiation to the roller. The radiator tube cooperates wih the combustion tube to form an annular space therebetween, through which space auxiliary combustion air is supplied to the combustion tube. Means are also provided for cooling the bearings of the roller.

The drawing shows, as an example, in diagrammatic form, one version of the equipment in accordance with the invention.

1 is a hollow cylindrical grooved roller, made of steel, of a corrugated paper machine, both ends of which are supported on roller bearings 2. 3 is a liquid gas container which is connected to a liquefied gas jet burner 6 via a pipeline 4 containing a pressure-reducing valve 5. 7 is a pipeline for secondary air leading to the burner 6. A flow regulating valve 8 or 9 is fitted in the liquefied gas pipeline and in the secondary air pipeline. A combustion tube 11 fabricated of chrome-nickel steel is located in the front part of the inside of the roller 1 along the axis of said roller, towards which the nozzle of the burner 6 is directed. At a concentric distance from the combustion tube 11, there is a radiator tube 10, of chrome-nickel steel, which is inserted about the former in surrounding relation thereto. The radiator tube 10 is approximately twice the length of the combustion tube 11 and extends along the interior 17 of the roller 1. The combustion tube 11 is provided with holes or perforations 18 to allow the entry of additional air from the annular space 15' formed between tubes 10 and 11. The perforations 18 become progressively smaller in size toward the end of combustion tube 11 remote from the burner 6. A heat shield 12 is fitted in the interior 17 at a distance from the radiator tube 10, at the end of the roller 1 facing the jet burner 6. The annular space 15 surrounding the heat shield 12, which is in the form of a section of pipe, is for the purpose of supplying fresh air and also of cooling the roller bearings 2, while the annular space 16 between heat shield 12 and radiator tube 10 enables the burnt gases to be extracted to the open, as indicated by the arrows A. In the interior 17 of the right-hand end of the roller 1, a further heat shield 13, also in the form of a section of pipe, is fitted coaxially with the roller 1. This heat shield 13 also serves to carry a deflector 14 which can be axially adjusted in the shield 13 and has parabolic surfaces 14'. The purpose of this deflector 14 is to turn the flowing combustion gases through substantially 180° and to guide the combustion gases in a return flow direction past the walls of the hollow space and along the exterior surface of the radiator tube 10 in a direction back toward the heat shield 12 and the jet burner. The heat shield 13 is at radially spaced from the inner wall 1' of the roller, and the air flowing in through the annular space 15'', as indicated by the arrows A', cools the right-hand bearing 2 of the roller.

The liquefied gas sprayed by the jet burner 6 into the combustion tube 11, and ignited therein, reaches a temperature of 1560° centigrade therein. The combustion tube 11 is raised to red heat. The radiator tube 10 is also heated by radiant energy from combustion tube 11, and gives rise to an even, radiant transmission of thermal energy to the more distant inner wall 1' of the roller 1, as is indicated by the arrows a. The heat absorbed by the inner wall 1' is propagated by conduction to the outer surface of the metallic roller 1 where, depending on the adjustment of the flow of liquid, said outer surface reaches a temperature of about 100° to 250° centigrade.

The combustion gases passing through the combustion tube 11 are re-routed by the deflector 14 and flow back along the outside of the radiator tube 10, in the course of which, on their way to the heat shield 12, they meet the fresh air involved in the cooling of the bearings 2 and, with it, leave the inner space 17 through the annular space 16. The size of the flame of the burner and, with it, the temperature of the roller, can be adjusted by means of the regulating valves 8, 9. The velocity of flow of the combustion gases and, as a result, the heat in the interior 17 of the roller 1, can be regulated by axial adjustment of the deflector 14 in the heat shield 13.

I claim:

1. In a corrugated paper making machine of the type having a plurality of heated, hollow cylindrical rollers fabricated of metal, each of said rollers being mounted for rotation in bearings adjacent the opposing ends of said roller respectively, an improved structure for heating the exterior surface of each of said rollers comprising an elongated metallic combustion tube extending into the interior of said hollow roller from one end of said roller in the axial direction of said roller, said combustion tube being comparatively widely spaced from the interior surface of said hollow roller, the walls of said combustion tube defining a plurality of air inlet perforations therein, an elongated imperforate metallic radiator tube extending into the interior of said roller from said one end of said roller in the axial direction of said roller, the exterior surface of said radiator tube also being spaced from the interior surface of said roller, said radiator tube being disposed in surrounding spaced relation to said combustion tube to define an annular region between the interior of said radiator tube and the exterior of said combustion tube, a liquefied gas jet burner located outside of said hollow roller adjacent said one end thereof and including a nozzle directed toward the interior of said combustion tube at said one end of said roller, means adjacent said one end of said roller for supplying auxiliary air to said annular region and thence via said air inlet perforations to the interior of said combustion tube to effect more complete combustion of liquefied gas from said jet burner within said combustion tube, the heat from said combustion tube being transmitted in a radial direction primarily by radiation to said surrounding radiator tube and being transmitted in a radial direction primarily by radiation from said radiation tube to the interior surface of said hollow roller and then being transmitted through the body of said roller in a radial direction by conduction from the interior surface of said hollow roller to the exterior surface of said roller, the combustion gases within said combustion tube flowing in the axial direction of said combustion tube toward the end of said combustion tube remote from said one end of said roller, a deflector structure disposed within said roller adjacent the other end of said roller for deflecting said axially flowing combustion gases, said deflector structure being shaped to deflect said combustion gases through substantially 180° for a return flow in a substantially axial direction back toward one end of said roller, the shape of said deflector structure being operative to guide said return flow of combustion gases away from the annular space between said combustion tube and said radiator tube and through the further annular space defined between the exterior of said radiator tube and the interior surface of said roller for exhaust from the end of said further annular space adjacent said one end of said roller.

2. The structure of claim 1 wherein said deflector structure has parabolic surfaces for deflecting said combustion gases and guiding said return flow of combustion gases.

3. The structure of claim 2 wherein said deflector structure is adjustable in position along the axis of the said roller for regulating the velocity of flow of the combustion gases.

4. The structure of claim 1 wherein said combustion tube is shorter in length than said radiator tube, the perforations in said combustion tube being progressively smaller in size in the direction towards said remote end of said combustion tube.

5. The structure of claim 4 wherein said combustion tube and said radiator tube are each fabricated of chrome-nickel steel.

6. The structure of claim 1 including a comparatively short tubular heat shield for protecting the bearing of said roller adjacent said one end of said roller, said heat shield being located in the interior of said hollow roller within said further annular space adjacent said one end of said roller in surrounding spaced relation to the exterior of said radiator tube and in spaced relation to the interior of said roller, the region at said one end of said roller between said heat shield and the interior of said roller being open for the admission of cooling air, and the region at said one end of said roller between said heat shield and the exterior surface of said radiator tube also being open for the exhaust of said cooling air along with the return flow of combustion gases.

7. The structure of claim 6 including a further comparatively short tubular heat shield for protecting the bearing of said roller adjacent the other end of said roller, said further heat shield being located in the interior of said hollow roller adjacent said other end of said roller in surrounding relation to said deflector structure, the outer surface of said further tubular heat shield being spaced from the interior surface of said roller to define an annular space therebetween which opens into said other end of said roller for the admission of cooling air to the interior of said roller from said other end of said roller.

8. The structure of claim 1 including a liquefied gas container, a pipeline connecting said container to said jet burner, a pressure reducing valve in said pipeline, a flow regulating valve in said pipeline, a secondary air pipeline leading to said jet burner, and a flow regulating valve in said secondary air pipeline.

* * * * *